US005146851A

United States Patent [19]

Anderson et al.

[11] Patent Number: 5,146,851

[45] Date of Patent: Sep. 15, 1992

[54] PRINT HEAD ASSEMBLY WITH A STATIONARY HEATER

[76] Inventors: Patrick H. Anderson, 14 Nortoft Rd., Chalfont St. Peter, Bucks SL9 OLD; Barry Kossick, 33 High Street, Winslow, Bucks, both of England

[21] Appl. No.: 733,007

[22] Filed: Jul. 19, 1991

Related U.S. Application Data

[63] Continuation of Ser. No. 594,667, Oct. 9, 1990, abandoned, which is a continuation of Ser. No. 254,101, Oct. 6, 1988, abandoned.

[51] Int. Cl.[5] ..... B41F 17/00; B41K 1/40

[52] U.S. Cl. ..... 101/305; 101/327

[58] Field of Search ..... 101/301, 305, 309, 310, 101/314, 315, 320, 321, 323, 324, 236, 333, 334, 327, 27, 41, 42, 43, 44

[56] References Cited

U.S. PATENT DOCUMENTS

| | | | |
|---|---|---|---|
| 3,241,482 | 3/1966 | Keck | 101/103 |
| 3,804,016 | 4/1974 | Marozzi et al. | 101/333 |
| 4,004,511 | 1/1977 | deGroot | 101/334 |
| 4,052,938 | 10/1977 | Kirby | 101/291 |
| 4,073,122 | 2/1978 | Areson | 101/44 X |
| 4,323,011 | 4/1982 | Hamilton | 101/305 |
| 4,444,108 | 4/1984 | Jenness, III | 101/320 X |
| 4,528,908 | 7/1985 | Davison et al. | 101/320 X |
| 4,566,386 | 1/1986 | Davison | 101/305 |
| 4,694,747 | 9/1987 | Marozzi | 101/301 |

FOREIGN PATENT DOCUMENTS

| | | |
|---|---|---|
| 0012068 | 6/1980 | European Pat. Off. . |
| 2503836 | 3/1976 | Fed. Rep. of Germany . |
| 1343286 | 1/1974 | United Kingdom . |
| 1526187 | 9/1978 | United Kingdom . |
| 2147854 | 5/1985 | United Kingdom . |

OTHER PUBLICATIONS

Overprint "Mini Coder" brochure.

*Primary Examiner*—Clifford D. Crowder
*Attorney, Agent, or Firm*—Nixon & Vanderhye

[57] ABSTRACT

A print head assembly for intermittently marking surfaces, such as packages and packaging materials, includes a heated ink supply means which engages with type elements as the latter move from a rest position, in which the type is heated, to a printing position, but which does not engage the type elements as the type elements move from the printing position to the rest position. The type preferably comprises rubber elements, heated in the rest position by a stationary heater. The ink supply preferably comprises an ink roll rotatably and freely mounted in an oven, wherein the ink roll remains in the oven throughout the whole operating cycle. Pneumatic cylinders are provided to move a type holder from the rest position to the printing position and vice versa, as well as for moving the ink supply means into and out of the path of the type holder.

26 Claims, 4 Drawing Sheets

PRINT HEAD ASSEMBLY WITH A STATIONARY HEATER

This is a continuation Ser. No. 07/594,667, filed Oct. 9, 1990, now abandoned, which was a continuation of application Ser. No. 07/254,101, filed Oct. 6, 1988, now abandoned.

BACKGROUND AND SUMMARY OF THE INVENTION

The present invention relates to a print head assemblies and in particular, to such assemblies which are suitable for use in the rapid sequential printing of packaging materials and/or other relatively flexible, flat stock surfaces.

There are increasingly implemented requirements that mass-produced packaged items carry bar codes, price details, packaging dates and/or "sell by" dates. In the case of dates, it is of course generally neither possible nor practical to integrate them into the basic package details that are printed on the stock of package blanks. Consequently, there exists a need for some means by which supplementary details can be printed onto packaging blanks shortly before they are used, and more frequently, at the point of packaging in light of the risk of either package material waste, or inadvertent use of pre-dated material of the wrong date. It is common knowledge that the majority of all items sold by, for example, all supermarkets in the United Kingdom and United States are individually date stamped. This practice is common to the majority of "consumer societies," and consequently, there exists a substantial need, worldwide, for equipment to apply such information.

Because of the tremendous number of items that are required to be printed with such information, it is, of course, important that the equipment be capable of very rapid and very reliable printing. Unfortunately, as with other industrial machinery, reliability and speed of operation generally have to be traded one against the other and, as a result, performance is often compromised. Consequently, there exist the twinned problems of how to improve operating speeds without a decrease in reliability, and how to improve reliability without reducing operating speeds. An optimum solution to these problems would improve both aspects of performance simultaneously.

Furthermore, in order to avoid the introduction of extra handling steps, it is desirable that printing machinery be readily adaptable to the packing machinery. Consequently, it is desirable for the printing machinery to be compact, self-contained and portable. Unfortunately, much of the conventional printing machinery is very bulky and/or has to be operated in a particular orientation, thus restricting the integration of the printing and packaging machines, as well as limiting the usefulness thereof.

Known print head assemblies that are configured to operate with hot ink tend to be considerably more complex than their conventional, non-hot ink counterparts and, as a result, their reliability may be reduced. In particular, hot-foil machines which use ink-carrying foils analogous to a typewriter's ribbon along with brass type, are disadvantageous because they are bulky, expensive and operate at high temperatures, typically about 130° C. Furthermore, such machines require that precise alignment (often to tolerances less than 1 thousandth of an inch) be maintained between the type and the work surface which is to be printed. Although hot-foil machines are widely used for printing goods packaged with wrapping or film packaging machines, the high temperatures and large printing pressures required frequently damage the packaging films.

It is an object of the present invention to provide an improved print head assembly for use with hot ink, and in which the aforesaid problems and disadvantages of known print head assemblies are mitigated or eliminated.

According to a first exemplary embodiment of the present invention, there is provided a print head assembly comprising: a type holder for carrying one or more type elements (hereinafter referred to merely as "type"); means for reciprocating the print head between a rest position and a printing position; ink supply means, including ink heating means, arranged in operation to supply the type with a heat-softened ink; and type heating means for maintaining the type in a heated condition when the type is in the rest position. The arrangement of components is such that the type carried by the type holder engages the ink supply means during passage of the print head and type holder from the rest position to the printing position, but does not engage the ink supply means on the return passage from the printing position to the rest position.

By using a thermoplastic ink and heated type, it is possible to largely overcome the problem of smeared ink (caused by the ink remaining wet after down time or other printing), even at high operating speeds. Moreover, by ensuring that the ink supply means and the type elements do not come into contact during passage of the type holder from the printing position to the rest position, the life of the ink supply is extended and unwanted build-up of ink on the type is minimized, thereby facilitating the maintenance of clear printing.

In an exemplary embodiment, the means for heating the type are mounted remote from the type holder. An advantage of such an arrangement is that the type can be heated from its printing surface inwardly, helping to minimize warm-up times after breaks in production. The means to heat the type remain stationary during normal operation of the assembly, and this helps to keep the reciprocating mass low, reducing wear and enhancing the overall reliability of the assembly.

In this exemplary embodiment, the means to heat the type may comprise an anvil against which the type rests when the type holder is in the rest position. Such an arrangement provides a compact heat source which facilitates the uniform and quick heating of the whole of the printing surface of the type. Preferably, the anvil includes an electrical heating element which can be removed without disassembly of the print head. This arrangement facilitates quick and cost effective repairs in the event the heating element requires replacement. Moreover, with the heating element held stationary, its associated electrical leads are not subject to repeated flexure, and hence are unlikely to fail by fatigue as in prior art arrangements.

Fluid power means are provided to move the ink supply means and the type holder as explained in greater detail below. The fluid power means preferably comprise air cylinders, facilitating the production of a compact and reliable unit, but other suitable drive means may also be employed. Correct synchronization of the movements of the ink supply means and the type holder is also facilitated by operatively connecting the cylinders for sequential or simultaneous movement.

The ink heating means in accordance with the invention comprises an oven which encloses and heats a supply of heat softenable ink. Use of the oven enables the supply of ink to be heated to a substantially constant temperature from the working surface inwards, and facilitates the use of type having lower thermal mass, which in turn, enables shorter warm-up periods. Print quality is also likely to be more consistent.

In an exemplary embodiment, the ink supply means comprises a substantially cylindrical cartridge including an ink impregnated roll mounted on a spindle or axle. In this exemplary embodiment, the oven substantially surrounds the cartridge and mounts the cartridge for relatively free rotational movement. At the same time, the oven is operatively connected to the above-mentioned fluid power means for movement into and out of the path of travel of the print head as will be explained in greater detail below. Means may also be provided for braking the free rotation of the ink supply roll to ensure more uniform distribution of ink on the roll.

The above explained arrangement of type heating means and ink supply heating means, in conjunction with the use of heat softenable ink (available in a range of colors), permits the use of type constructed of rubber or like material. This is advantageous since the flexibility of the rubber allows greater tolerance, i.e., the type surface and surface to be printed need not be perfectly parallel. In addition, rubber type, unlike metal type, will not perforate the typically thin film surface to be printed, thus eliminating exposure of the package contents, such as food, to the print head, type, ink, etc. which would otherwise require disposal of the package. Rubber type is also substantially less expensive than metal type.

In a related aspect of the invention, the printing unit may be adjustably mounted atop a control box which permits adjustment of the type and ink heating means, as well as the printing speed.

It will be appreciated that the above described print head assembly has several advantages over prior art print head devices including fast start up; easily changeable rubber type elements which will not puncture the printed film surface; lubrication free components which avoid film contamination; and rapid printing speeds of 120 to 200 prints per minute.

Additional objects and advantages of the subject invention will become apparent from the detailed description of the accompanying drawings.

DETAILED DESCRIPTION OF THE DRAWINGS

Figure 1:
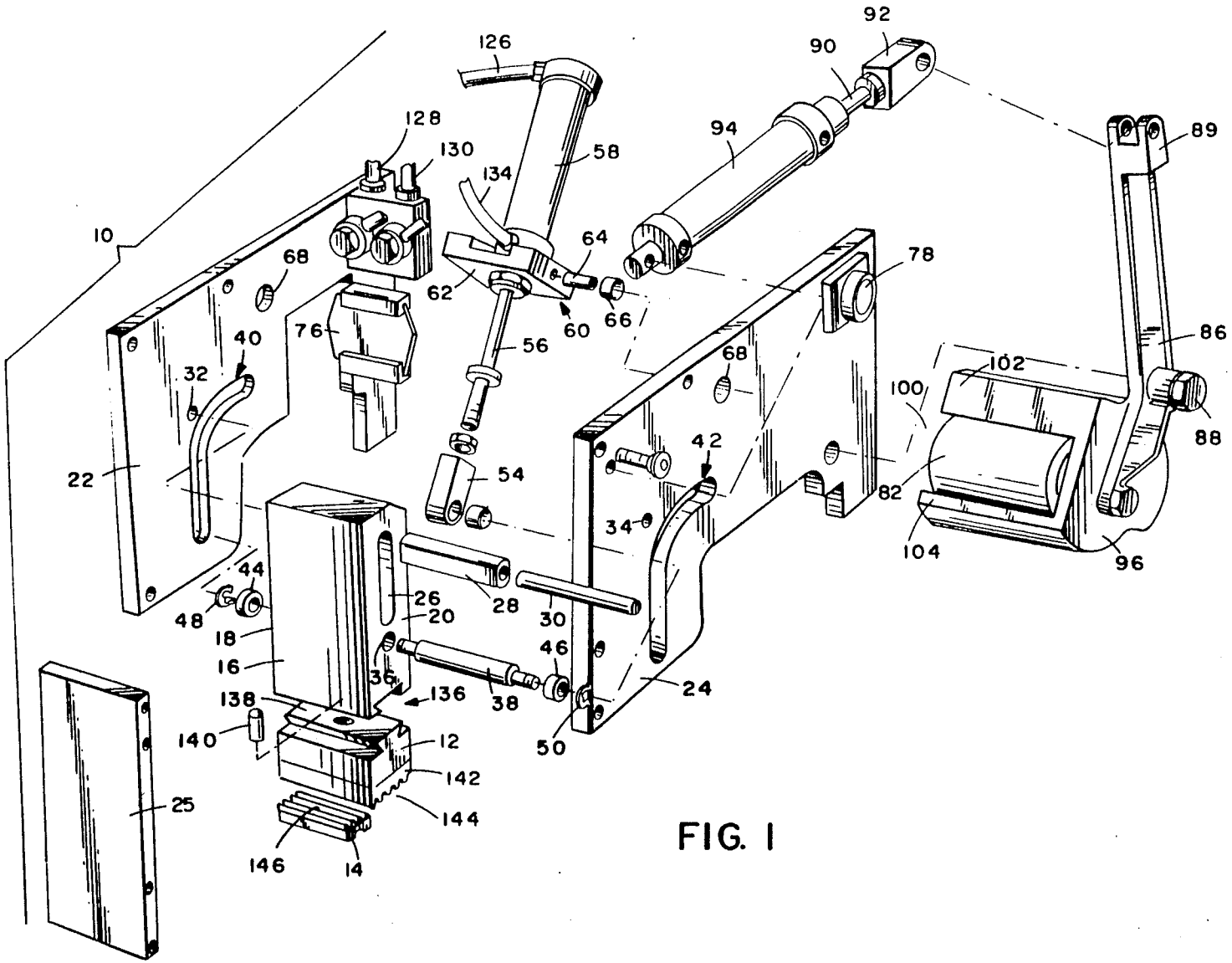
FIG. 1 is an exploded view of the print head assembly in accordance with the invention.

With reference to the drawings, the print head assembly 10 according to the present invention comprises a type holder 12 on which is mounted one or more removable type elements 14. The type holder 12 is mounted on one end of an elongated block 16. The block 16 has opposed side faces 18, 20 which face two substantially parallel side plates 22 and 24, respectively which are joined by an end plate 25. Plates 22, 24 and 25 are preferably coated on all surfaces with Teflon TM to minimize accumulations of dust, dirt, etc. The block 16 is provided with a longitudinal slot 26 within which is received a stationary bearing sleeve 28 having a bore through which extends a spindle 30. The ends of spindle 30 are received in apertures 32, 34, respectively, in the side plates 22 and 24.

Also extending between the two side faces 18 and 20 of the block 16 is a bore 36 located in alignment with the longitudinal axis of the slot 26, and between one end of the slot and the type holder 12. Through the bore 36 there extends a second spindle 38, the ends of which are engaged in identical curved slots 40 and 42 formed in the two side plates 22 and 24. To enable the ends of the second spindle 38 to move freely in the slots 40 and 42, sleeve bearings 44 and 46 are mounted in reduced diameter end portions of the spindle 38, and between the walls of the slots 40 and 42. The bearings, which may be retained in place by circlips 48, 50, or other suitable means, are free to "roll" within the slots as the type holder 12 and block 16 move between rest and print positions as described in greater detail below.

Figure 7:
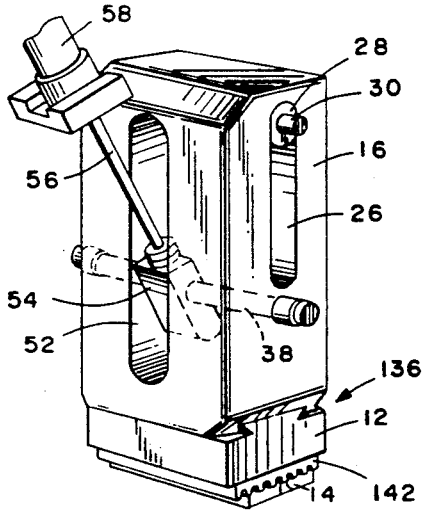
FIG. 7 is a partial perspective showing in detail of an elongated block which mounts the type holder in accordance with the invention.

As best seen in FIG. 7, another longitudinal slot 52 is provided in the front face of the block 16, for receiving an end block 54 of a piston rod 56 which extends from a fluid-power device, such as air cylinder 58. The piston rod end block 54 is pivotally attached to the second spindle 38, within the slot 52.

The body of the air cylinder 58 is secured between the two side plates 22, 24 by means of a pivot mounting 60. More specifically, a plate 62 is mounted to the forward end of the cylinder 58 and is provided with a pair of pins 64 (one of which is shown in FIG. 1) which, in turn, mount sleeve bearings 66 which are received in apertures 68 in side plates 22, 24, respectively. By this arrangement, the cylinder 58 is effectively confined between the plates 22, 24, but is pivotally movable in relation thereto about an axis defined by the pins 64.

As thus far described, the printing head assembly is known, corresponding generally to our own prior print head assembly sold under the trade name Mini-Coder TM.

Figure 2:
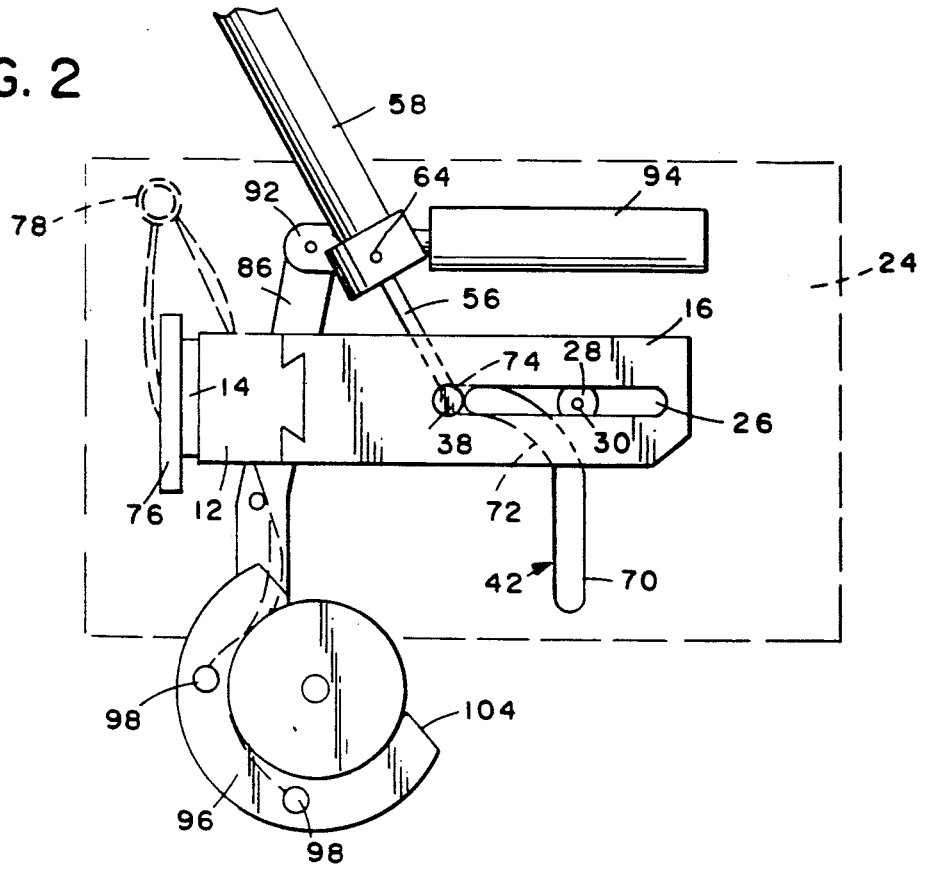
FIG. 2 is a partially schematic side elevation of a print head assembly according to the present invention in the rest position and with parts removed for purposes of clarity.

The path of movement of the type holder as described will now be discussed in detail with reference to FIGS. 2, 3 and 4. In its at-rest or non-printing position, the block 16 and type holder 12 are retracted within the space between side plates 22, 24 as shown in FIG. 2. When the piston 56 of air cylinder 58 is extended, the type holder 12 is driven out from between the side plates 22 and 24. During this extension of the piston 56, the block 16 is caused to swing approximately 90° as it moves from the rest to the printing position shown in FIG. 4. The path of movement of the block is controlled by the slots 40, 42 which constrain the movement of the spindle 38 which serves as a movable pivot axis for the block 16 and associated type holder 12.

When the spindle 38 is at the mid-point MP (FIG. 3) of its arcuate, path of approximately 90°, the type holder 12 and associated type 14 are in an inking position wherein type 14 engages an ink supply roller as described in further detail below.

The slots 40, 42 terminate in a substantially straight portion 70 so that, upon further extension of the piston 56, block 16 and type holder 12 travel substantially at 90° to the printing position where the type 14 strikes a stationary package or other surface to be printed. It will thus be appreciated that the type holder 12, type 14 and block 16 travel in a substantially linear path immediately before and after printing. Preferably, the linear portion 70 of the path extends at least 20 mm, thereby accommodating packages of various heights or thicknesses.

It will be appreciated that as the piston 56 extends to move the block, the cylinder 58 will pivot somewhat about its own pivot mounting 60, as the cylinder adjusts to the movement of the block 16.

After printing is completed, retraction of the piston 56 initially draws the type holder back in a straight path from the fully extended printing position (FIG. 4) as the spindle 38 follows the straight portion 70 of the curved slots 40, 42. As the spindle 38 enters the arcuate portion 72 of the slots, the type holder is drawn out of its former straight path in an arc towards the cylinder 58. During this part of its travel the type holder is effectively pivoting about the first spindle 30. As the second spindle 38 returns to the mid-point MP of its arcuate path, the block 16 has retracted so that the bearing sleeve 28 is at the distal end of the slot 26 which is closest to the type holder 12. Thereafter, continued retraction of the piston 56 into cylinder 58 draws the holder 58 further round towards the cylinder 58, while the second spindle 38 moves from the arcuate portion 72 of the curved slots to a second straight portion 74 and the limit of travel. At this point, the block 16 and type holder 12 are in the rest position which corresponds to the inking position in the prior art Mini-Coder TM .

The following features and operating steps are new to this invention and particularly concern the provision and use of a thermoplastic (heat-softenable) ink which enables hot inking to be carried out simply and efficiently, using very reliable, compact and portable equipment.

When the type holder 12 is in its rest position, the type 14 abuts against an anvil 76 which is slidably mounted between the side plates 22, 24. As will be appreciated, the slideable mounting of anvil 76 allows it to be removed and/or replaced without disassembly of the side walls 22, 24. In the example shown, the anvil is in the form of a flat plate in which is embedded a thermostatically controlled electric heating element, although other heating means, such as hot fluids passed through the anvil or hot air impinging on the anvil (or directly on the type) may be used. As best seen in FIGS. 2–4, current is supplied to the electric heating via leads connected to a multi-connector jack 78, which, in turn, receives a power cable C from an external source. It will be understood that the power cable C may be connected to a control unit 80 by which the temperature of the anvil plate 76 may be regulated as required.

The use of an electrically heated anvil is particularly convenient in that it is compact, inexpensive, easy to service and enables the supply of heat to be largely confined to the type itself rather than heating the type holder as well. Thus, the heating is much more efficient than, for example, heating the type from behind, through the type holder. Moreover, since the electrical heating element is stationary, its associated electrical leads will not be subject to fatiguing stress caused by movement of the type holder.

A supply of ink is provided in the form of a roll or cartridge 82, impregnated with a thermoplastic ink. One suitable thermoplastic ink is known as Eurofoil, although other suitable heat-softenable inks may be used. The roll 82 is mounted in such a way that it can be brought into engagement with the type 14 as the type holder 12 moves from its rest position to the printing position. The roll 82 is mounted on a spindle 84 which is freely rotatably mounted at one end of a crank arm 86 which in turn is pivotally mounted via bolt 88 (defining a pivot axis) or other suitable means to the side plate 24. At the opposite end of the crank arm 86 there is a yoke 89 which pivotally mounts a piston rod 90 provided with an end block 92. The block 92 is pinned or otherwise pivotally secured within the yoke 89. The piston rod 90 extends from a fluid-power device, in this case a second air cylinder 94, which is secured, at its other end, to the side plate 24 by any suitable means, such as a threaded screw or the like. As will be described further below, cylinder 94 provides the means by which the ink supply roll 82 is moved into and out of the path of the type holder 12, type 14 and block 16.

An oven 96 is attached to the crank arm 86, and substantially surrounds or encloses the ink supply roll 82. The oven 96 is fitted with one or more electric heating elements 98 which serve to heat the roller to a temperature in the range of about 90° C.–130° C., at which the thermoplastic ink acquires sufficient fluidity to be transferred to the type 14 when it engages with the roller.

Figure 3:
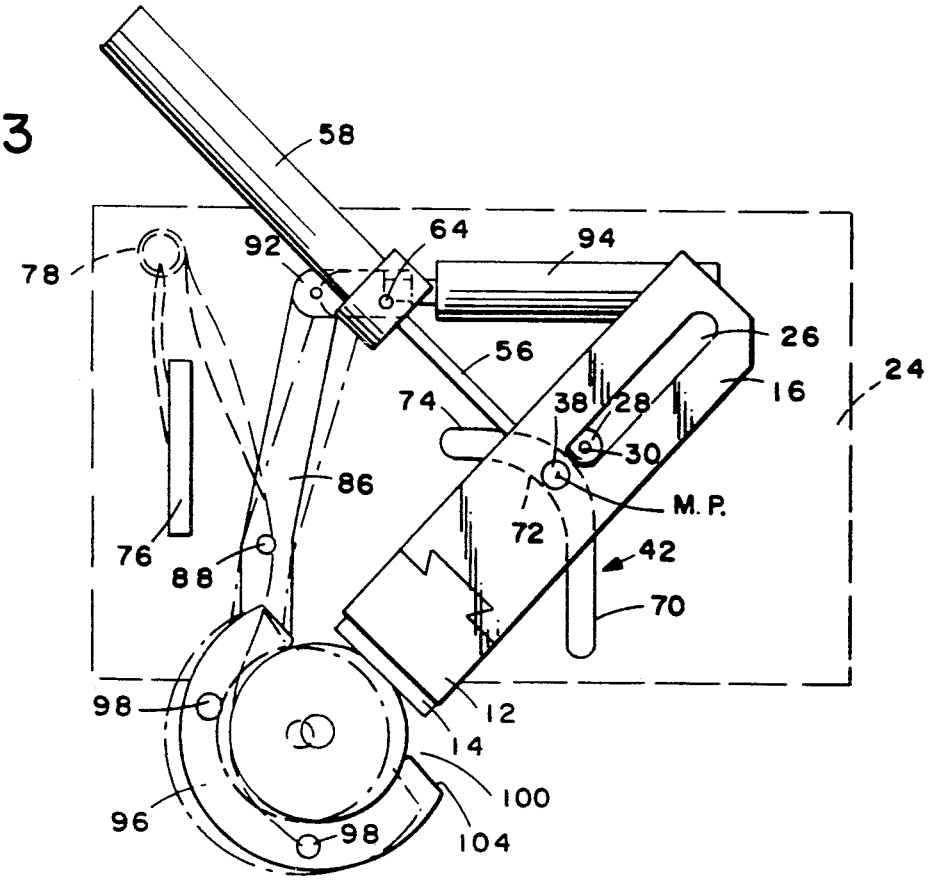
FIG. 3 shows the assembly of FIG. 1 in an intermediate inking position.
Figure 4:
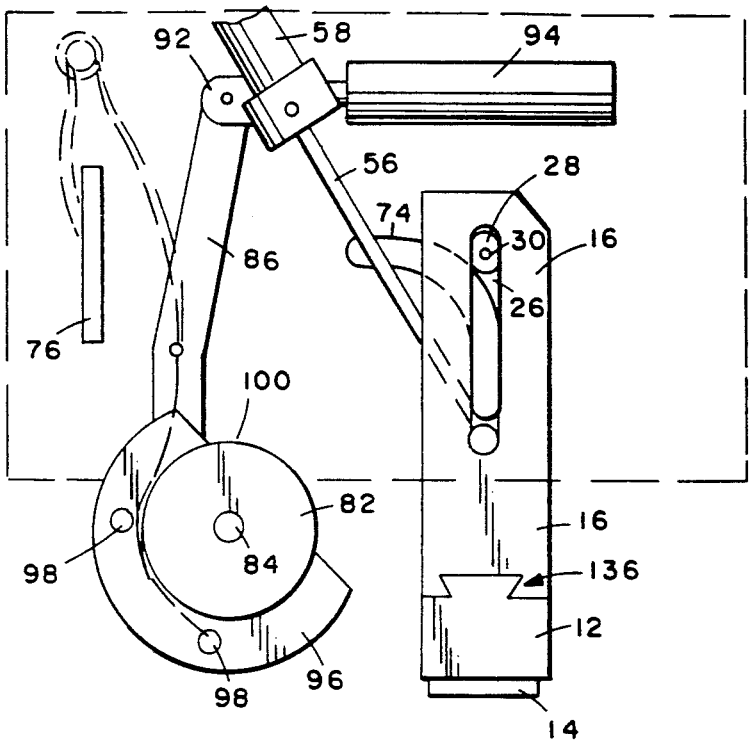
FIG. 4 shows the assembly of FIG. 1 in the printing position.

Preferably, and as best seen in FIGS. 2–4, electrical leads from the heating element(s) 98 run along the inside of crank arm 86 to the region of the bolt 88 before attachment to the connector jack 78 mounted in side plate 24. By taking the leads from about the pivot point of the crank arm, the likelihood of fatigue failure of the leads is markedly reduced. It will be appreciated that the temperature within the oven may also be controlled by unit 80.

It will be noted that part of the periphery of the ink roll 82 protrudes from an opening 100 in the oven wall. As will be described in more detail below, it is from this protruding portion of the roll 82 that ink is transferred to the type 14.

In the exemplary embodiment shown, the ink roll 82 is rotated along with its spindle 84, only by the action created by its engagement with the moving type 14 during the ink transfer stage. Consequently it is desirable that the oven encloses as much of the ink roll as is compatible with the clearance needed to ensure that the type 14 has sufficient access to the ink roll. To this end, the external surfaces of the oven adjacent the opening are chamfered, as at 102, 104, to permit clearance of the print head while maximizing enclosure of the ink roll. Since the ink roll is not required to reciprocate in-and-out of the oven, the opening 100 in the wall of the oven can be, and preferably is, smaller than the diameter of the ink roll. Surprisingly, it has been found that under normal circumstances, if there is sufficient enclosure of the ink roll, there is no need to provide means to rotate the ink roll continuously. Consequently, the ink roll may be freely mounted, to be rotated only as, and when, the moving type 14 engages with it during movement of the type holder and type from the rest to the printing position.

There may be some applications, where there are likely to be long intervals between printing sessions and where the ambient temperature and particular ink properties are such that the exposed portion of the ink roll hardens during work breaks, in which case it is found preferable to provide means to rotate the ink roll continuously or intermittently to ensure uniform and reliable ink transfer. Where the ink roll is provided with such a drive, there is preferably also provided some form of 'free-wheel' mechanism to enable the ink roll to be driven or slowed by the type when the type and ink roll engage, since it is desirable for the ink roll surface and the face of the type to move at the same speed when they are engaged, i.e., so that there is no relative movement between the two surfaces.

Figure 6:
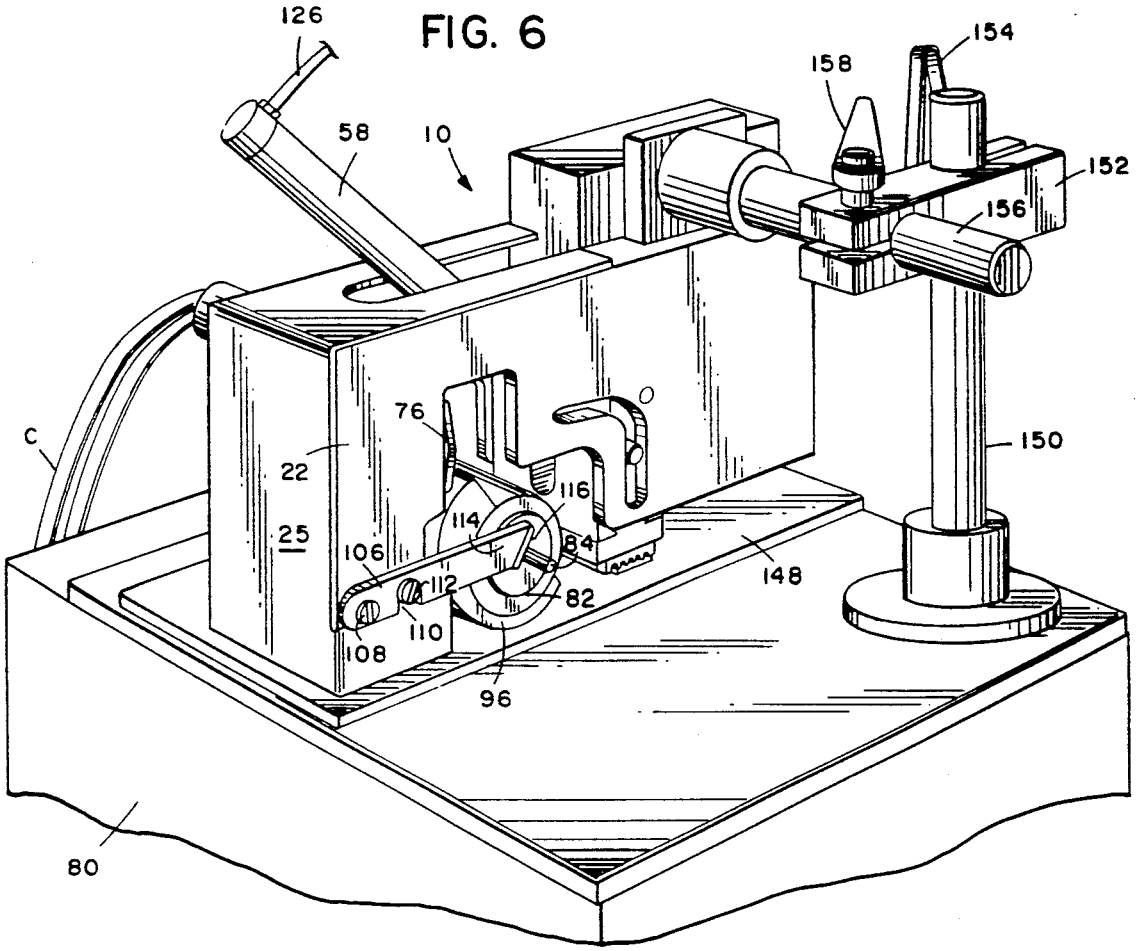
FIG. 6 is a perspective view of the print head assembly of this invention adjustably mounted atop a control box in accordance with another aspect of the invention.

In the exemplary embodiment illustrated in the drawings, best seen in FIG. 6, a braking arm 106 is pivotally mounted to the side plate 22 by a screw 108 or other suitable means. At the same time, a slot 110 is provided in the arm 106, intermediate its ends, for receiving a screw 112 mounted in the side plate 24 and substantially horizontally aligned with the screw 108. The free end 114 of the arm 106 is provided with a rubber tip 116 or other friction means. It will be appreciated that arm 106 may be rotated clockwise (with reference to FIG. 6) until tip 116 engages spindle 84. Slot 110 provides a means for adjusting the pressure exerted on the spindle by the arm. By appropriate adjustment of the arm, rotation of the wheel 82 may be restrained so that it rotates only during contact with the type 14, and at substantially the same speed. After type 14 passes the wheel 82, rotation of the wheel is halted due to the friction created by engagement with the rubber tip 116. By thus controlling the rotation of wheel 82, uniform wearing and dispensing of the ink from roll 82 is assured. This, in turn, results in longer service life for the roll, for example, an additional 50,000 impressions can be expected with controlled rotation of the ink supply roll.

The method by which ink is supplied to the type 14 from the roll 82 in accordance with this invention will now be described.

With reference initially to FIG. 3, it will be seen that when the piston rod 90 of cylinder 94 is extended, the crank arm 86 is rotated about pivot 88 to move the ink supply roll 82 and oven 96 into an inking position, shown in the solid line configuration in FIG. 3, where type 14 will engage the roll 82 as it moves from the at-rest position to the inking position. When the piston rod 90 is retracted, the crank arm 86 will pivot the ink supply roll 82 and oven 96 away from the path of movement of type 14, as shown in phantom in FIG. 3.

At the start of a printing cycle, the type 14 is in contact with the heated anvil 76 (FIG. 2), while the ink roll 82 has been heated to operating temperature in the oven 96. As the piston rod 56 of the first air cylinder 58 is extended, the type moves out of contact with the anvil. Extension of the piston rod 56 of the second air cylinder 94 may commence simultaneously or even somewhat in advance of the extension of cylinder 58, but in any event, the extension must be sufficiently complete, so that the ink roll 82 is in position for engagement with the type 14 before the type arrives. Extension of the piston rod 56 continues and eventually brings the leading edge of the type 14 into contact with the periphery of the ink roller 82 (FIG. 3). Still further extension of the first piston rod 56 moves the type 14 past the roll 82, it being understood that type 14 and roll 82 move at the same speed during contact, ensuring a uniform coating of ink on the type, and even wear of the roll. The inked type then continues in its trajectory to the printing position (FIG. 4) where ink is transferred to the packaging material or other surface to be printed.

Return of the type holder 12 and type 14, along with block 16, to the rest position occurs as described previously, but it is to be noted that the second cylinder 94 must be actuated to retract piston rod 90 before the fist piston 56 is retracted, so that the ink roll 82 is moved out of the path of the type 14 to preclude any contact of the type with the ink supply roller 82 during return travel of the type holder to the rest position. By avoiding contact between the ink supply roll and the type in this half of the print cycle, undesirable build-up of ink on the type 14 and anvil 76 is avoided, and the life of the ink roll 82 is extended.

Figure 5:
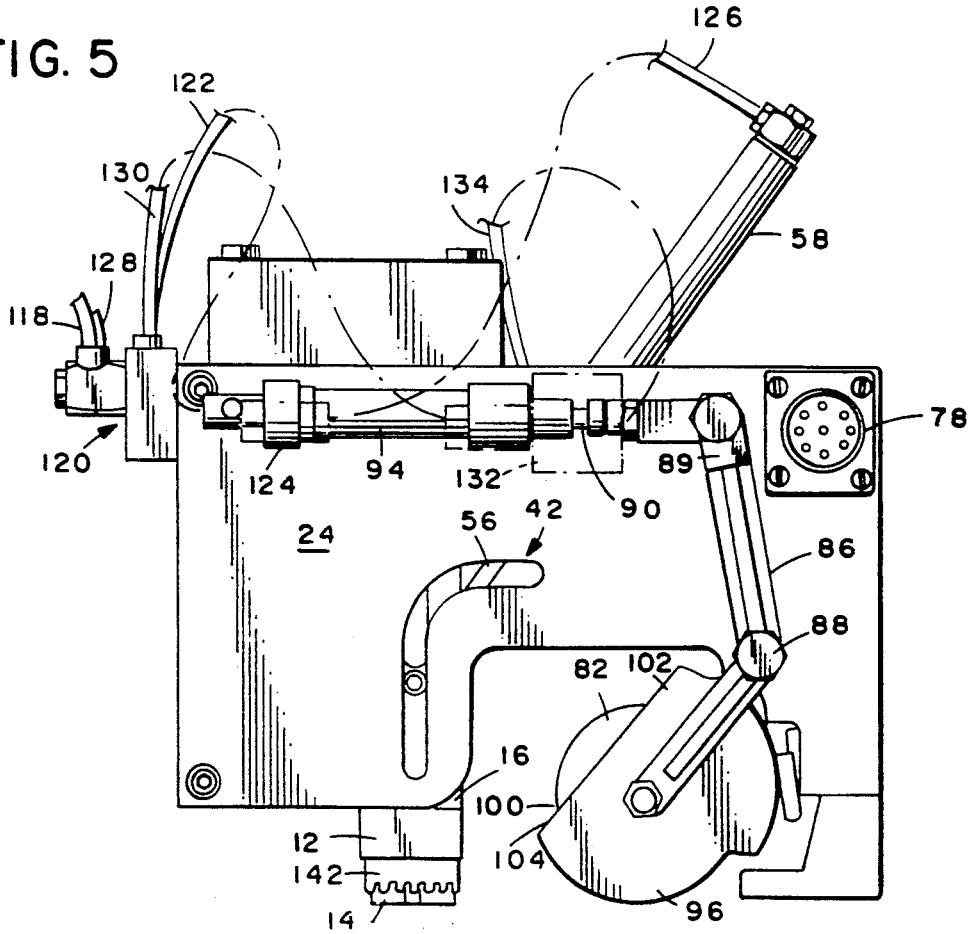
FIG. 5 is a side elevation as shown in FIG. 1 but from the opposite side of the assembly, and with the side plates attached.

In order to insure the synchronized movement of piston rods 56 and 90 of air cylinders 58 and 94, respectively, the cylinders are interconnected, as best seen in FIG. 5. Thus, a first main inlet tube 118 inputs to a pressure regulator 120 which, in turn, supplies air via tube 122 to a second regulator 124 which feeds air to the extension side of cylinder 94 and, via tube 126, to the extension side of cylinder 58. At the same time, a second inlet tube 128 also inputs to the pressure regulator 120 which, in turn, supplies air via tube 130 to a third regulator 132 which feeds air to the retraction side of cylinder 94 and, via tube 134, to the retraction side of cylinder 58. The regulators serve to synchronize the two piston rods 56 and 90 for cyclical movement as described hereinabove. It will be appreciated that the inlet tubes 118 and 128 may be connected to a suitable control device within the unit 80 to permit adjustment of printing speed as desired.

By virtue of the fact that the type 14 is heated by applying heat at its working face rather than by applying heat from behind, for example, through the type holder, it is feasible to use rubber type, and the manner in which the rubber type is mounted to the type holder is described in detail below. The type holder 12 is secured and, in fact, preferable, to the block 16 by means of a dovetail arrangement 136. With reference to FIG. 1, accidental disengagement therebetween is guarded against by providing a ball catch 140 in the rear face 138 of the type holder 12. The ball catch cooperates with a suitable indent (not shown) in the face of the block 16. Additionally, the dovetail structure 136 is arranged so that forces encountered by the type holder as it moves through the printing cycle are likely to be orthogonal to the direction in which the type holder and block separate most readily.

On the opposite face of the type holder 12 there is secured, with adhesive for example, a rubber block 142. On the front face of the rubber block is a comb-like pattern of raised parallel ribs and grooves 144. Mating with the ribbed and grooved face of the rubber block 142 is a substantially identical ribbed and grooved surface 146 on the rear face of the rubber type 14. The ribs and grooves on face of the block 142 and surface 146 extend orthogonally to the direction of movement of the type in use.

Since the type 14, and to a certain extent the rubber block 142, are exposed to temperatures which may be in the range of 80° C. to 130° C., typically about 90° C., suitable rubbers for these parts must offer a reasonable service life when operated in this environment. Suitable rubbers include RCSSN and WR3503, available from Plastatype Ltd. Preferably, a rubber with a Shore hardness of about 90 is preferred. The rubber block 142 may be a composite block, i.e., the ribbed front portion and the back portion which is attached to the type holder may be formed separately and then secured, by gluing or welding for example, together.

Although it is surprising that rubbers are suitable for use as type with hot inks, we have found that extended service lives (more than 350 thousand operations) can be achieved in accordance with this invention. The use of rubber type brings with it numerous advantages: rubber type is markedly less expensive than the equivalent conventional brass type; rubber type can generally be produced much more quickly than equivalent metal type; unlike metal type, rubber type does not require that the surface being printed is precisely flat and parallel to the surface of the type face; and because of the lower thermal mass and the relatively poor thermal conductivity of the rubber type, it can be readily changed when hot without significant danger of burning the operator. In addition, the lower thermal mass of the rubber type also means that it can rapidly attain operating temperature, consequently machine downtime while type is changed may be significantly reduced.

A further advantage to the use of rubber type, is that it can provide speedy and reliable printing of film wrapped products, without significantly risk of film damage by e.g., perforation, or poor print quality.

With reference now to FIG. 6, the print head assembly is illustrated in portable form, mounted atop the control unit 80 which is provided with means for horizontally and vertically adjusting the print head relative to a platen 148, which may also be constructed of relatively hard rubber or other suitable material.

Specifically, a vertical support 150 slidably mounts a clamping block 152, including a knob 154 which may be used to tighten the block against support 150 at any desired height therealong. At the same time, clamping block 152 also slidably receives a horizontal support 156 which may be adjusted relative to the block 152 and tightened in place by a second knob 158. The horizontal support 156 is fixedly secured to the print head assembly 10 by any suitable conventional means. The adjustment means described above forms no part of the invention per se and is merely exemplary of any number of conventional means which may be employed to provide horizontal and vertical adjustability to the print head assembly relative to a support surface or other packaging apparatus with which the assembly is intended to be used.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A print head assembly comprising:

a type holder for carrying type;

means for moving the type holder between a rest position and a printing position where the type is pressed into direct engagement with an article to be printed, said type lying in a first plane in said rest position and in a second plane in said printing position, said first and second planes being substantially perpendicular to each other;

ink supply means adapted to supply the type with a heat-softenable ink when said type holder is between said rest and printing positions, and wherein the ink supply means is arranged to engage the type during movement of the type holder from the rest position to the printing position, but to not engage the type upon return movement of the type holder to the rest position; and stationary means for heating the type, said stationary heating means lying substantially in said first plane such that said type engages said stationary heating means when said type holder is in the rest position.

2. A print head assembly as claimed in claim 1 wherein the assembly further comprises means for heating the ink supply means.

3. A print head assembly as claimed in claim 2 wherein said ink supply means comprises a substantially cylindrical ink cartridge, and wherein said ink heating means comprises an oven which substantially surrounds said ink cartridge.

4. A print head assembly as claimed in claim 3 wherein said, ink cartridge is substantially freely rotatable within said oven.

5. A print head assembly as defined in claim 2 wherein said means for heating said ink supply means is adapted to heat said ink supply means to a temperature in the range of about 80° to about 130° C.

6. A print head assembly as claimed in claim 1 wherein the means to heat the type comprises an anvil slidably mounted between a pair of side walls.

7. A print head assembly as claimed in claim 6 wherein the means to heat the type further comprises an electrical heating element mounted within the anvil.

8. A print head assembly as claimed in claim 1 wherein the means for moving the type holder comprises a first fluid power device.

9. A print head assembly as claimed in claim 8 wherein a second fluid power device is provided to move the ink supply means to a first position where said ink supply means will engage the type during movement of the type holder from the rest position to the printing position, and to a second position where said ink supply means will not engage the type during movement of the type holder from the printing to the rest position.

10. A print head assembly as claimed in claim 9 where in the first and second fluid power devices are operatively connected to act in concert with each other.

11. A print head assembly as claimed in claim 9 wherein said ink supply means comprises a substantially cylindrical rotatable cartridge mounted within an oven operatively connected to said second fluid power device.

12. A print head assembly as claimed in claim 1 wherein said ink supply means comprises a substantially cylindrical rotatable cartridge.

13. A print head assembly as claimed in claim 1 wherein said type are comprised of rubber.

14. A print head assembly as defined in claim 13 wherein the rubber type has a shore hardness of about 90.

15. A print head assembly as defined in claim 1 wherein said type are mounted to a flexible support block which, in turn, is mounted to said type holder.

16. A print head assembly as defined in claim 15 and wherein said flexible support block is comprised of rubber.

17. A print head assembly as defined in claim 1 wherein said stationary heating means is adapted to heat said type to a temperature in the range of about 80° to about 130° C.

18. A print head assembly as defined in claim 1 wherein said ink supply means carries thermoplastic ink.

19. A print head assembly for use in an overprint device comprising a type holder mounting type elements for reciprocal compound movement between a rest position where said type elements lie in a first plane, and a printing position where said type elements lie in a second plane substantially perpendicular to said first plane, wherein the compound movement is defined by a path of travel including arcuate and linear portions, the arcuate portion extending through substantially 90°, a first linear portion terminating in the printing position and a second linear portion terminating in the rest position; stationary heating means for heating said type elements in the rest position, said stationary means including a substantially flat anvil plate slidably mounted between a pair of side walls of the assembly;

wherein the type holder comprises an elongated block, and the assembly further includes guide means for guiding the movement of said block along said path of travel; first fluid power means pivotally connected to the elongated block at a movable pivot axis constrained for movement along said path of travel by said guide means; stationary bearing means engageable with said power means for constraining displacement of the elongated block about the pivot axis;

ink supply means located such that said type elements engage said ink supply means approximately midway along the path of travel of the type holder as the type holder moves between the rest position and the printing position; and second fluid power means for moving said ink supply means out of the path of said type holder as said type holder moves from the printing position to the rest position.

20. A print head assembly as defined in claim 19 wherein said guide means includes a pair of laterally spaced and substantially parallel plates, said plates provided with aligned, elongated slots defining said path of travel, wherein said elongated block is mounted between said plates; and wherein said movable pivot axis including a spindle having ends engageable in said slots.

21. A print head assembly as defined in claim 20 wherein said elongated block is provided with a substantially straight elongated slot for receiving said bearing means.

22. A print head assembly as defined in claim 20 wherein said power means comprises a first piston and cylinder assembly, wherein the piston is connected to said elongated block and the cylinder is mounted for pivotal movement between said pair of plates..

23. A print head assembly as defined in claim 19 wherein said ink supply means comprises a rotatably mounted cartridge having a roll member impregnated with ink.

24. A print head assembly as defined in claim 23 wherein said ink is a heat softenable ink, and wherein means are provided for heating said roll member.

25. A print head assembly as defined in claim 24 wherein said type holder includes a rubber block mounting rubber type elements.

26. A print head assembly as defined in claim 19 wherein said first and second power means are operatively connected for synchronized movement of said type holder and said ink supply means.

* * * * *